United States Patent [19]

Paxton

[11] 4,077,187

[45] Mar. 7, 1978

[54] COLD CO-CYCLING BAG CLOSURE IMPRINTING AND BAG CLOSING MACHINE

[76] Inventor: Jerre H. Paxton, P.O. Box 2098, Yakima, Wash. 98902

[21] Appl. No.: 768,153

[22] Filed: Feb. 14, 1977

[51] Int. Cl.[2] ..... B65B 61/02; B41F 17/00

[52] U.S. Cl. ..... 53/131; 101/27; 101/44

[58] Field of Search ..... 53/131, 138 A; 101/7, 101/41, 44

[56] References Cited

U.S. PATENT DOCUMENTS

| | | | |
|---|---|---|---|
| 1,539,853 | 6/1925 | Littlefield | 101/27 |
| 3,331,320 | 7/1967 | Young et al. | 101/27 X |

*Primary Examiner*—Travis S. McGehee
*Attorney, Agent, or Firm*—Dana E. Keech

[57] ABSTRACT

An improved bag closure imprinter is substituted for the various styles of printing devices heretofore associated with the closure applying system of the Kwik Log Bag Closing Machine, (No. 1081) shown basically in U.S. Pat. No. 3,163,972, issued Jan. 5, 1965.

The new cold tape ink bag closure imprinter is fixed on top of the tower-like frame of the bag closing system and becomes an integral part of the bag closing machine. Although having its own drive motor and clutch, the printer is individually cycled successively at a given point in each cycle of the closing system so as to fully coordinate both departments of the machine.

36 Claims, 17 Drawing Figures

Fig. 9
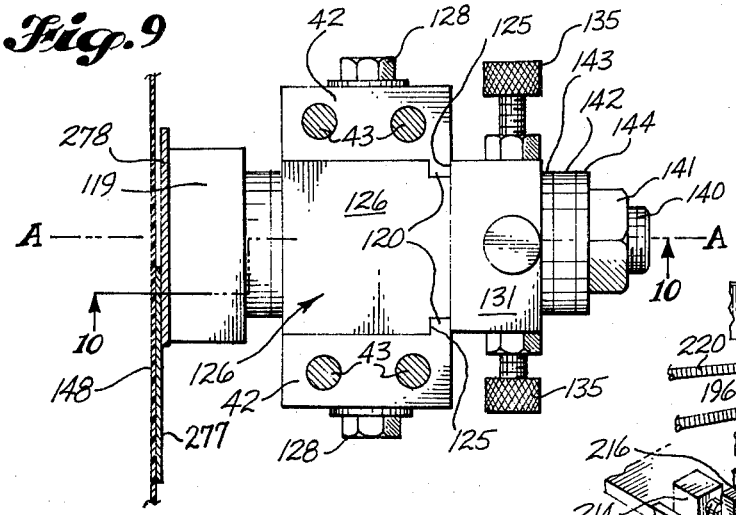
Fig. 11
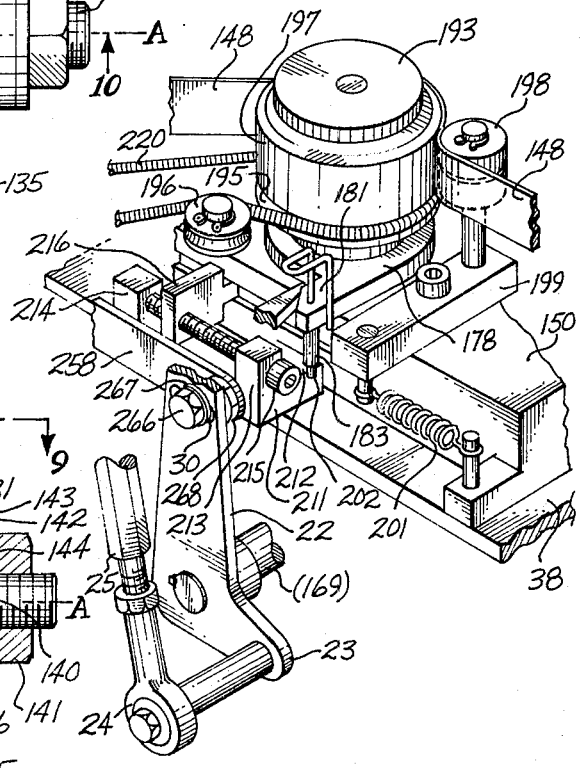
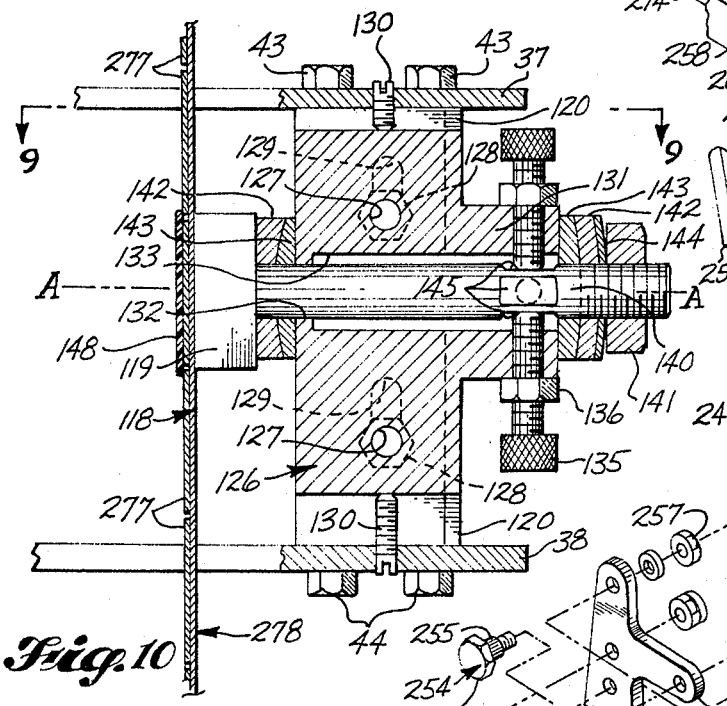
Fig. 10
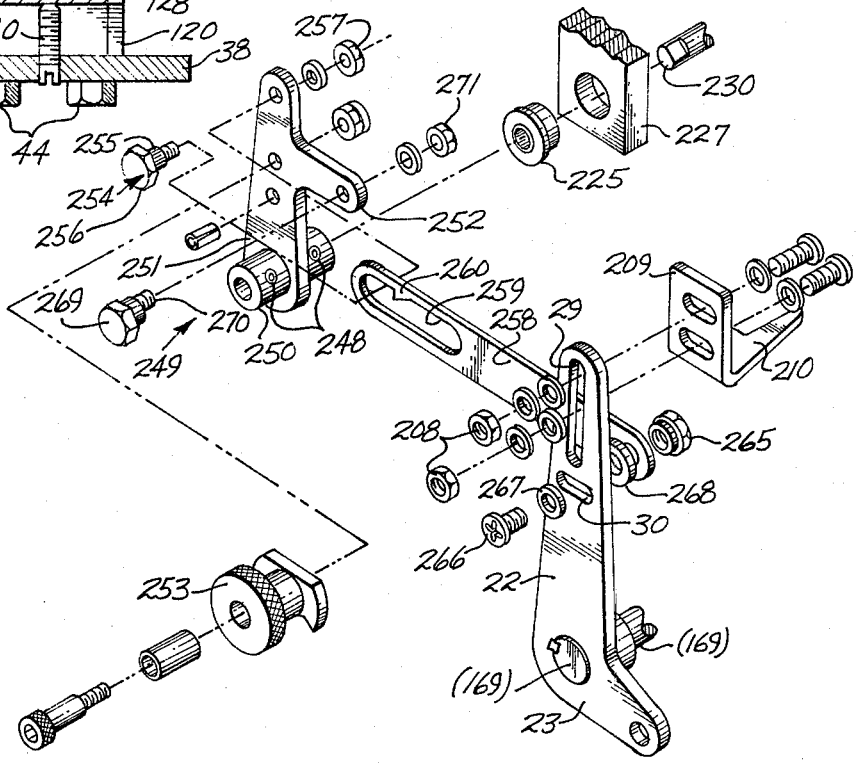
Fig 12

COLD CO-CYCLING BAG CLOSURE IMPRINTING AND BAG CLOSING MACHINE

SUMMARY OF THE INVENTION

Many problems successively became chronic in the performance by those closure printing devices heretofore used on the Kwik Lok Bag Closing Machine such as, for instance, the element of quick evaporating solvent in the ink and the heat and temperature control there involved, while more recently the use of an air cylinder for printing the closures failed to yield sufficiently uniform and excellent results because of fluctuations in the air pressure supplied to the machine.

Included among the objects motivating the conception and the development of the present invention are:

1. Elimination of problems in closure printing by unreliable sources of air pressure.
2. Elimination of deterioration of type by high impact of type against anvil when air pressure is excessive.
3. Attainment of uniformly excellent images in practically all printing.
4. An imprinter which cycles so as to keep pace with the bag closing system at widely varying speeds up to and including the present maximum of 120 bags per minute.
5. A bag closure imprinter which combines a flywheel, a chain to chain transmission and a cam to concentrate the torque of a relatively lightweight low-power drive motor at the moment of imprintation in each cycle thereby producing an excellent cold dry image on the closure with a minimum of energy being released in the form of heat.
6. An imprinter in which the type faces will not hit the anvil when the strip of closures and ink ribbon are temporarily out of supply in the machine.
7. An imprinter doing a first class printing job on polystyrene bag closures passing therethrough by maintaining a very closely adjusted spacing of the type faces relative to the work.
8. An imprinter the type of which is positively cam propelled into its printing position while under strong spring retraction, and thus has the power behind it to compensate for uneven plastic thickness beneath the type as well as for drops of glue (unavoidable on glued labels) when printing closure-labels.
9. Such an imprinter as is backed by sufficient power to effect an embossing characteristic which provides legible printing even with failure of the supply of ink printing foil.
10. An imprinter providing a maximum of adjustability devices including, among others, the following:
    (a) for printing off center or exactly on center, whichever is desired.
    (b) for manually interrupting the imprinter whenever it is desired to close bags with un-imprinted closures or labels.
    (c) to regulate the length of ink tape fed for each closure printed for economical use of ink tape.
    (d) multidirectional bodily adjustability in printing anvil support to maintain work in parallelism with printing face of type.
    (e) operative coordinational margins are precisely adjustably maintainable between co-cyclic patterns of the two clutch triggered power systems of the machine.

BRIEF DESCRIPTION OF THE DRAWINGS

FIG. 9 is a plan view of the imprinter anvil mount taken on line 9—9 of FIG. 10.

FIG. 10 is a vertical longitudinal sectional view taken on line 10—10 of FIG. 9.

FIG. 11 is a fragmentary perspective view of the ink ribbon feed mechanism similar to FIG. 8 and partly broken away to disclose hidden details thereof.

FIG. 12 is an exploded perspective detail view of the imprinter clutch cycle actuating and regulating mechanism.

DETAILED DESCRIPTION OF THE PREFERRED EMBODIMENT

Figure 1:
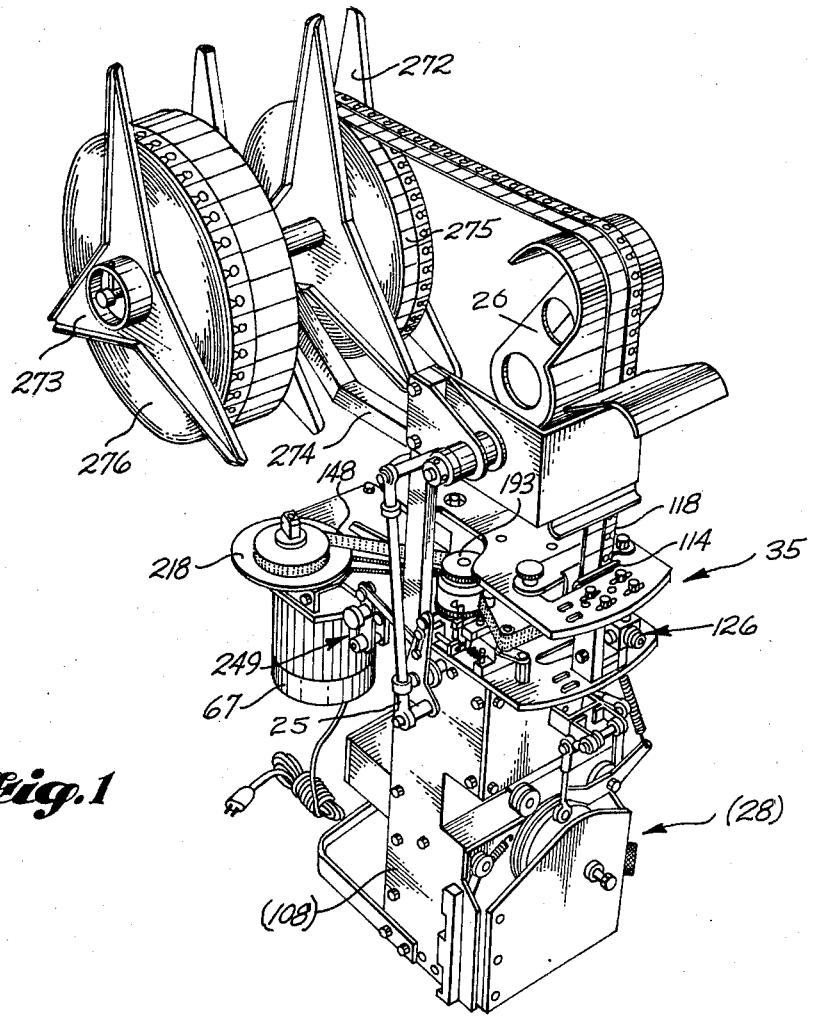
FIG. 1 is a diagrammatic perspective view of a preferred embodiment of the invention with the parts shown positioned at rest during an interval between successive operational cycles.
Figure 2:
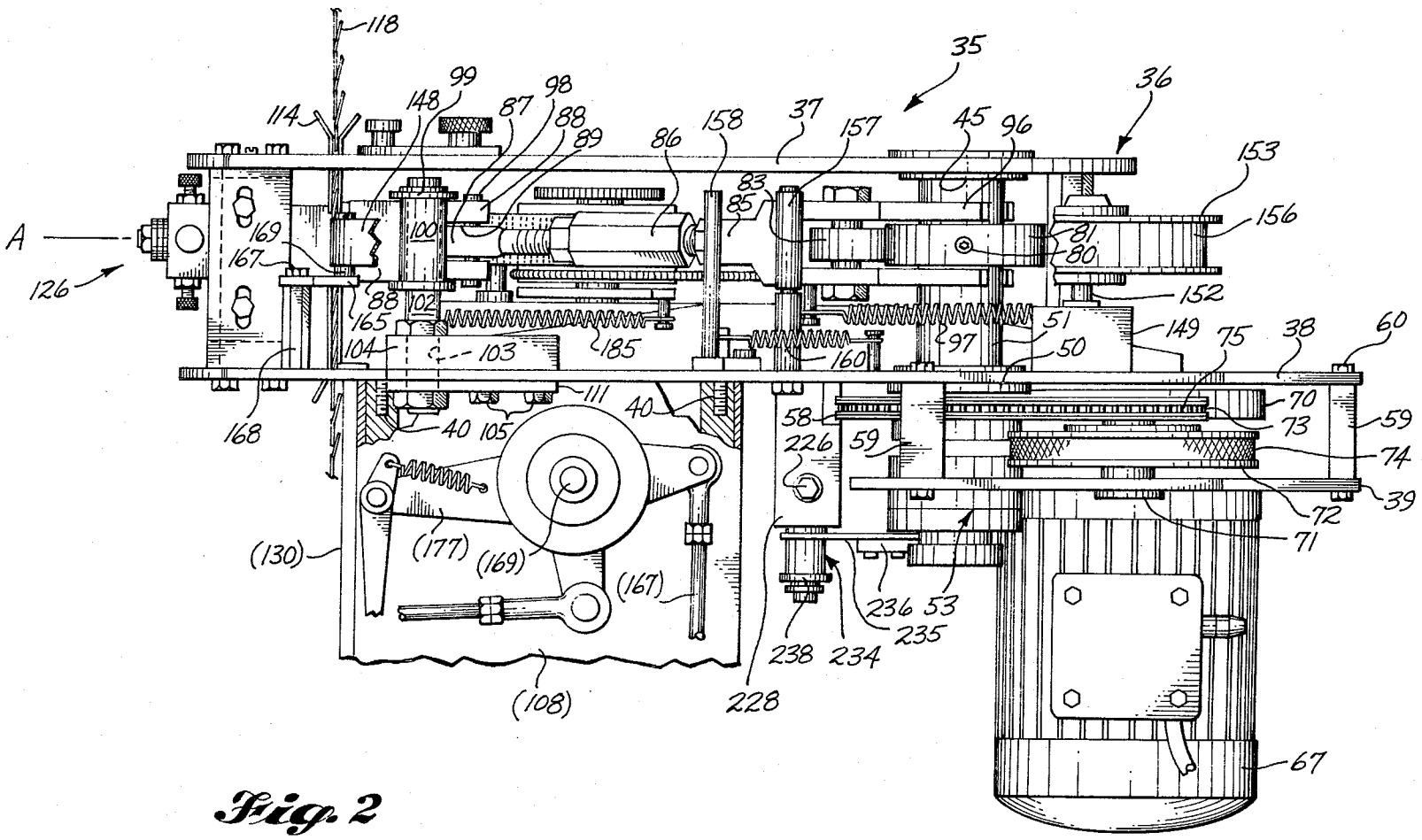
FIG. 2 is a fragmentary side elevation of the imprinter head of the invention mounted on the upper end of the tower-like frame of the bag closing system thereof. The inking tape is broken away in places to reveal details of the otherwise hidden structure and the machine parts are at rest.

Inasmuch as the present invention is an improvement taking off from U.S. Pat. No. 3,163,972 issued to Jere F. Irwin on Jan. 5, 1965, reference is hereby made to the disclosure in said patent of those elements common both to said patent and the present invention. The patent reference characters used to identify such elements will be parenthetically distinguished from reference characters originating in this application.

Everything shown in the Irwin patent is germane to the present invention excepting the bag closure printer 251 which embraces actuating arm 176, supporting post 252, links 257 and 268, rubber type and ink roller elements 265 and 273, pressure plate and biasing spring 222 and 246, and the top housing tower plate 132. The above enumerated elements are no part of the present invention.

The elements disclosed in said patent and incorporated in the present invention comprise a bag closing system 20 including the following items:

1. A conveyor 26 for delivering partially loaded polyethylene bags in a uniformly arranged serial order along a given path leading to and through a work station;
2. A cyclically powered means for intermittently advancing flat springy sheet plastic bag closures along a different path leading to said work station to successively position such a closure with respect to each foremost loaded bag delivered to said work station, to present a flat neck portion of said bag to a bag neck trapping aperture in said closure;
3. Means for gathering into the trapping aperture of the closure the slack bag neck presented thereto;
4. Means for releasing said closure to allow it to depart with said bag from said machine; and
5. Provisions for coordinately power driving elements 1 through 4.

Irwin's loaded bag conveyor 26 and bag neck flattener 27 are independently powered, care merely being taken not to overcrowd the bag closing machine 28 embracing elements 2, 3 and 4. Machine 28 is powered by a single electric motor 134 mounted within the bottom of a tower shaped housing 108 and geared down to drive an output shaft 135 at 120 R.P.M. which is chain connected to shaft 138 and to clutch 151 on shaft 139. Thus, shaft 138 carrying bag neck gathering wheels 147 and 148 is constantly driven to tangentially drive smaller wheels 284 and 283 and thus successively whip bag necks between said two pairs of tangential wheels and into the bag neck trapping aperture of a closure waiting at said work station located between said pairs of wheels. Clutch 151 is tripped by trigger 299 each time a bag neck is fed to the work station thus causing a single revolution of shaft 139 and through eccentric link 167 a partial two way rocking of shaft 169. This functions through arm 177 and spring biased link 239 to laterally shift the endmost closure in the closure strip guide 205 that has just had a bag neck gathered into its capturing aperture, thereby separating such closure from the strip and permitting said closure to depart with said bag from the machine. The closure separation and feed cycle then concludes with the advancing of the closure strip one closure length to replace the departed closure with the next closure properly positioned at the work station for receiving the neck of the next bag.

On the opposite side of frame tower structure 108 from that on which shaft 169 has arm 177 secured thereto, said shaft has fixed thereon a bell crank 21 including an upwardly extending arm 22 and a laterally extending arm 23. Pivotally connected by a self-aligning bearing 24 to the outer end of arm 23 is a turnbuckle link 25 which extends upwardly to actuate a closure strip unrolling device 26, the latter being supported on a closure reel supporting post 27 connected by bolts 28 to the tower housing 108.

The upper end portion of upwardly extending arm 22 is provided with a lengthwise slot 29 and, beneath this, a lower crosswise slot 30, the purpose of which slots will be made clear hereinafter.

A disclosure of the bag closing system 20 of the invention as this is to be found in U.S. Pat. No. 3,163,972 having been pointed out hereinabove, reference is now made to the drawings of the present application to specifically describe the other major elements of the invention comprised in a cold dry ink ribbon bag closure imprinter 35. This printing system is intimately integrated with a triple deck cold rolled steel plate framework 36 including upper, middle and lower boiler plate decks 37, 38 and 39 which are rigidly united in vertical parallel spaced relation in a manner to be pointed out and the entire framework is then rigidly united by bolts 40 to the upper end of tower housing 108 which also houses and embodies therewith the mechanism of the bag closing machine 28.

Figure 7:
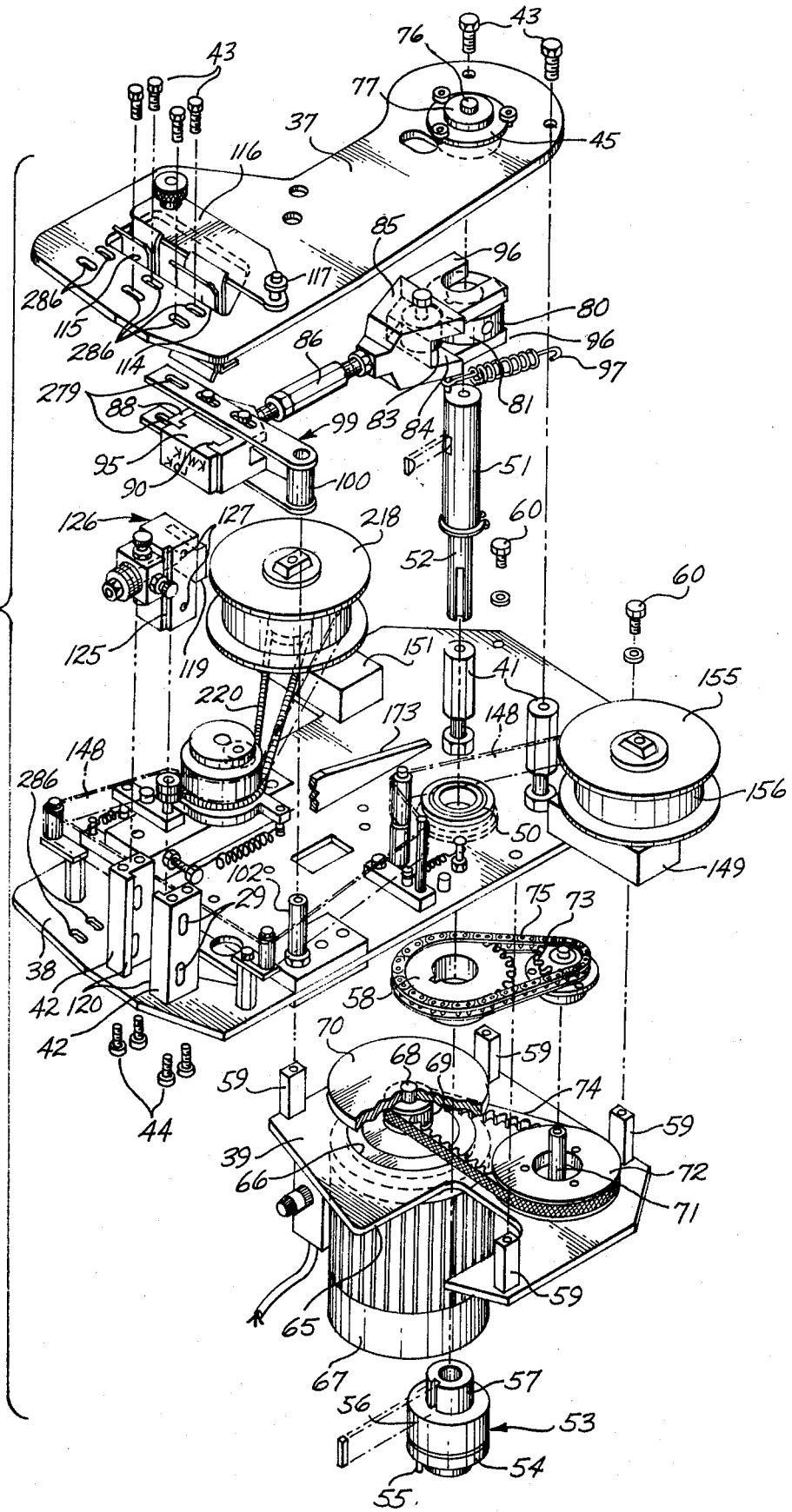
FIG. 7 is an exploded perspective view of most of the imprinter parts with broken lines diagrammatically indicating the assembled relation of such parts.

Referring specifically to FIG. 7 which is an exploded view of the imprinter 35, the upper and middle decks 37 and 38 are rigidly united in parallel spaced relation by a pair of spring anchor posts 41 and a pair of anvil anchor posts 42 by bolts 43 and 44 extending downwardly through deck 37 and upward through deck 38.

Just inwardly from the spring anchor posts 41, upper and middle decks 37 and 38 are vertically co-axially apertured to receive main cam shaft ball bearings 45 and 50 in which upper and lower end portions of cam shaft 51 journal, a still lower end portion of which shaft is reduced in diameter to form a clutch shaft 52 on which a single revolution clutch 53 is mounted. The lower portion 54 of said clutch has a control dog 55 and is keyed to clutch shaft 52. An upper portion 56 of said clutch continuously rotates relative to the lower portion 54 when said control dog is engaged but said lower portion is instantly given a single revolution when said control dog is disengaged.

The upper half of upper clutch portion 56 is turned down to provide a keyed hub 57 on which a relatively large diameter sprocket 58 is keyed. It is thus seen that the sprocket 58 is located directly beneath the lower main cam shaft bearing 50 and the clutch 53 is directly below said sprocket and both are rigidly supported on the lower end of clutch shaft 52.

It is also to be noted in FIG. 7 that the lower deck 39 of the imprinter framework 36 is rigidly supported in parallel spaced relation on the middle deck 38 by four posts 59 rigidly secured to said decks at their upper and lower ends by bolts 60. A notch 65 is provided in lower deck 39 to accommodate the clutch 53 and a circular aperture 66 is also provided in lower deck 39 in which an electric motor 67 is rigidly secured, said motor having a shaft 68 on which are fixed a pinion gear 69 and a flywheel 70. Also fixed on lower deck 39 is an idle shaft 71 on which journal idle gear 72 and idle pinion 73 co-axially united therewith. The idle gear 72 is in the same radial plane with the pinion gear 69 and it is connected therewith by a toothed belt 74 while the idle pinion 73 is in the same radial plane with the sprocket 58 and is connected thereto by a chain belt 75.

It is thus seen that electric motor 67, the normal speed of which is 1700 RPM builds up a considerable inertial torque momentum in the fly wheel 70 which enables the motor to deliver a substantially higher torque load to the much more slowly rotating clutch 53 when the latter is engaged to transmit a single revolution through the cam shaft 51.

Secured to the top end of cam shaft 51 by a screw 76 is a washer 77 which supports said cam shaft on the upper race of main cam shaft bearing 45. Fixed on the cam shaft 51 by two set screws 80 is a cam 81 having a relatively deep detent 82 for a purpose which will be made clear hereinafter. A cam roller 83 is rotatably mounted in a deep horizontal slot 84 formed in a knuckle 85 which is pivotally connected by a lineally adjustable turnbuckle 86 having a screw eye 87 at its opposite end with a type mounting block 88 by said screw eye extending into a horizontal slot 89 formed in the back of said block, there being a vertical rabetted slot 90 formed in the front face of said block 88 for the receiving of solid type faces 95.

A pair of guide yokes 96 which slideably fit shaft 51 above and below cam 81 are screwed to the rear end of knuckle 85 so as to slideably engage upper and lower faces of cam 81 and opposite sides of cam shaft 51 so as to guide the cam roller 83 in proper radial alignment with the cam 81. The cam roller 83 is held in constant pressurable contact with said cam by a pair of coil springs 97 which are attached at their opposite ends to the knuckle 85 and to spring anchor posts 41.

The screw eye 87 is pivotally connected to the type mounting block 88 by a vertical pin 98. A bifurcated arm 99 having a hub 100 overlies and underlies the type mounting head 88 and is secured thereto by screws 101. The hub 100 of arm 99 is pivotally mounted on a vertical axis on a vertically and horizontally adjustable post 102 having a hex head at its middle and having its lower portion threaded to screw into a tapped hole 103 provided in a mounting block 104 which is secured to middle deck 38 by screws 105 which pass upwardly through holes provided in a bottom plate 111 then through slots provided in middle deck 38 and then are threadedly received in holes provided in mounting block 104.

By thus coordinately adjusting the cam 81 and post 102, the cam and type faces 95 can be coordinately brought into the same horizontal radial plane which coincides with the printing location of a closure being fed vertically through the imprinter 35 through a closure strip guide 114 which extends downwardly through a hole 115 provided in upper deck 37. During operation of the machine, a safety door 116 is pivotally mounted on screw 117 is kept swung closed to prevent the fingers accidentally being extended into the path of the printing block 88.

The printing operation of the imprinter 35 is accomplished in a printing area of the path along which closure strip 118 is fed downwardly through the closure strip guide 114 and in which the closure strip is backed up by an anvil 119 which is rigidly anchored to the anvil anchor posts 42.

Referring to FIGS. 9 and 10, it is noted that the two anchor posts 42 are rabetted on their inner faces to provide ribs 120 which fit inwardly into vertical recesses 125 provided in an anvil mounting and adjusting block 126 which block is provided with tapped holes 127 to which four screws 128 have access through vertical slots 129 which are formed in anvil anchor posts 42 to permit vertical adjustment of the anvil mounting and adjusting block 126. Another element useful in such vertical adjustment comprises a pair of set screws 130 which are threadedly received in tapped holes provided in upper deck 37 and middle deck 38 so that said screws may be adjustably brought to bear against upper and lower ends of block 126 and used for making fine adjustments in the vertical position of said block while the screws 128 are loosened.

Concentric with an axis A—A disposed slightly above the middle of the block 126 is a forwardly extending boss 131, the block having a bore 132 which is concentric with said boss and which is located only adjacent the inside face of said block, a counterbore 133 extending throughout the balance of the axial length of the block 126 and boss 131. Four radial tapped holes 134, two vertical and two horizontal, are provided in the boss 131 to receive knurled adjusting screws 135 having set nuts 136.

The anvil 119 is a rectangular hard steel block integrally mounted on one end of a cylindrical steel stem 140 which closely fits the bore 132 but with enough tolerance to permit oscillation of the stem about bore 132 within the limits allowable by the counterbore 133. The front end portion of the stem 140 is threaded to receive a nut 141 and cushioning pairs of spheroid washers 142 and 143 slipped onto the stem 140 between the anvil 119 and the block 126 and between the boss 131 and a washer 144 which is preferably of the Belleville type (associated No. B0750-028) which absorbs the friction set up between the nut 141 and the spheroid washer located at the front end of the stem 140.

To prevent the stem 140 rotating the anvil 119 out of plumb due to various adjustments of the inclination of this stem made by manipulation of the four adjusting screws 135, flat faces 145 are formed on the outer surface of the stem 140 directly opposite and in planes normal respectively to the screws 135.

The spheroid pairs of washers 142–143 have matching interfitting convex-concave faces which automatically adjust the two washers of each pair during the axial angular adjustment of the anvil 119, while the stem nut 141 is loosened, so that when said nut is tightened again, the spaces between the juxtaposed radially flat faces of anvil 119, the washer 144 and the block 126 are uniformly packed with the material of the spheroid washers. Furthermore, these spheroid washers are preferably made of a resilient material such as polyurethane so that the anvil 119 has a cushioned mounting enabling it to yield to avoid damaging the type as when abnormal thicknesses of plastic or glue are accidentally fed between the type and the anvil during the printing operation.

As shown in FIGS. 2 to 7 inclusive a printing foil ribbon feeding system 147 is mounted on the middle boiler plate deck 38 for the purpose of intermittently advancing a foil ribbon 148 between type faces 95 and the anvil 119 during the operation of the imprinter 35.

This system includes aluminum blocks 149, 150 and 151 which are screwed onto edge portions of said deck. Journalled in a vertical bore in block 149 is a shaft 152 on which is fixed a ribbon spool 153. A plunger brake 154 is provided in block 149 to frictionally engage shaft 152 to adjustably retard rotation of spool 153. This spool is for holding a fresh roll 156 of foil ribbon 148 while the ribbon is being withdrawn at said level from said spool by operation of the imprinter 35. A small diameter idle ribbon guide roller 157 is vertically mounted on middle deck 38 close to cam roller mounting knuckle 85. Another similar ribbon guide roller 158 is vertically rotatably mounted on the outer free end of an arm 159 which is pivotally secured to deck 38 at the inner end of said arm and then biased toward spool 153 by a coil spring 160.

A pair of arms 165 and 166 are adjustably secured by bolts 167 at their inner ends, which bolts extend through posts 168 and into deck 38 so that ribbon guide rollers 169 and 170, vertically rotatable on outer ends of said arms, are outwardly vertically tangent with the back face of closure strip 118, where the front face of said closure strip lies flat against the closure supporting rear face of anvil 119. Formed in a side edge 171 (see FIG. 5) of middle deck 38 is a notch 172 to accommodate the closure reel supporting post 27. Welded longitudinally to deck 38 and spaced inwardly from said notch is a cold rolled sheet steel plate reinforcing web 173.

The aluminum base block 150 fits between deck edge 171 and web 173, is shaped to extend behind post 27, and is screwed securely to deck 38 by two screws 174. Mounted in a vertical bore in block 150 is a clutch bearing 175 (Torrington No. RCB-061014-FS) in which a foil feed drive shaft 176 is inserted and held downwardly by a collar 177 affixed to its lower end.

Pivotally received on shaft 176, and lying flat on block 150, is a foil feed actuator lever 178 having a circular body with a central bearing 179 and an eccentric hole 180 and tangential peripheral ears 181 and 182 the first of which has mounted therein a downward extending tubular stop 183 and the other ear 182 having a pin 184 which a coiled contractile spring 185 connects to a screw 186 received in block 150. The bearing 179 fits over shaft 176 and freely turns thereon in either direction. Lever 178 is thus spring biased to turn in a clockwise direction by spring 185.

Also rotatably fitting onto shaft 176 is a collar 190 having a pin 191 fitting into eccentric hole 180 so as to rotationally lock collar 190 to lever 178. Mounted in the central bore of collar 190 is a clutch bearing 192 identical with clutch bearing 175.

A hollow foil feed drive roller 193 fits downwardly over both collar 190 and the upwardly extending end of shaft 176 and is fixed to the latter by a set screw 194, so as to be rotated intermittently and counterclockwise, only, by said shaft. An annular pulley groove 195 is provided at the lower end of drive roller 193 and a similarly grooved small diameter idler pulley 196 is pivotally mounted in co-radial relation on block 150.

A resilient frictional rubber band 197 fits snugly over drive roller 193 to provide a good traction between it and foil ribbon 148 held against said drive roller by an idle roller 198 supported on a rocker 199 pivoted at 200 on block 150 and constantly biased by a coil spring 201 towards the foil ribbon drive roller 193.

A spring wire latch 202 extends downward through tubular stop 183 and includes a keeper 203 bent therefrom to retain the latch confined within tubular stop 183 during normal running of the imprinter 35.

Figure 5:
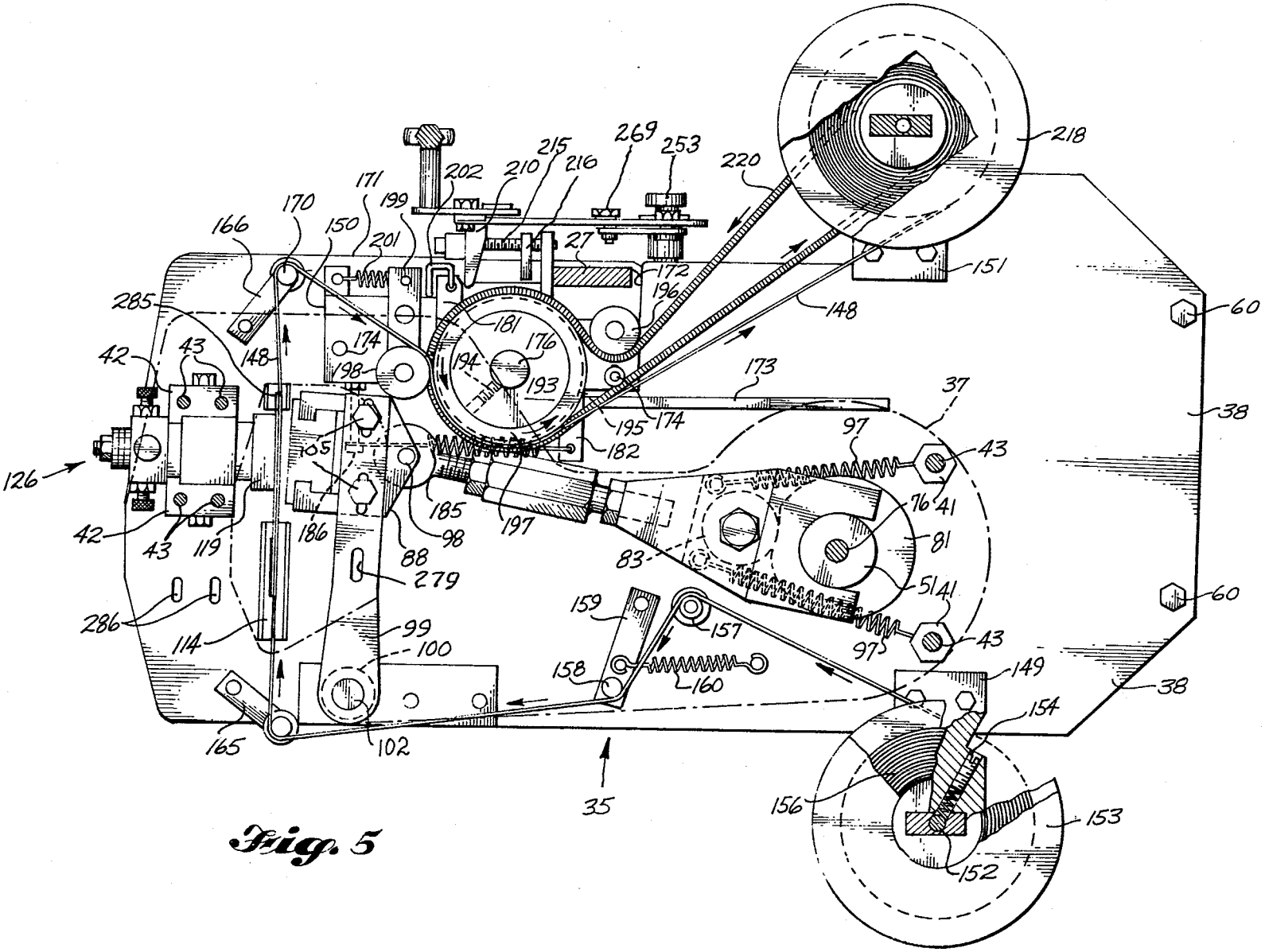
FIG. 5 is a horizontal sectional view taken on line 5—5 of FIG. 3 with the operative parts positioned as at the end of a cycle of operation.
Figure 8:
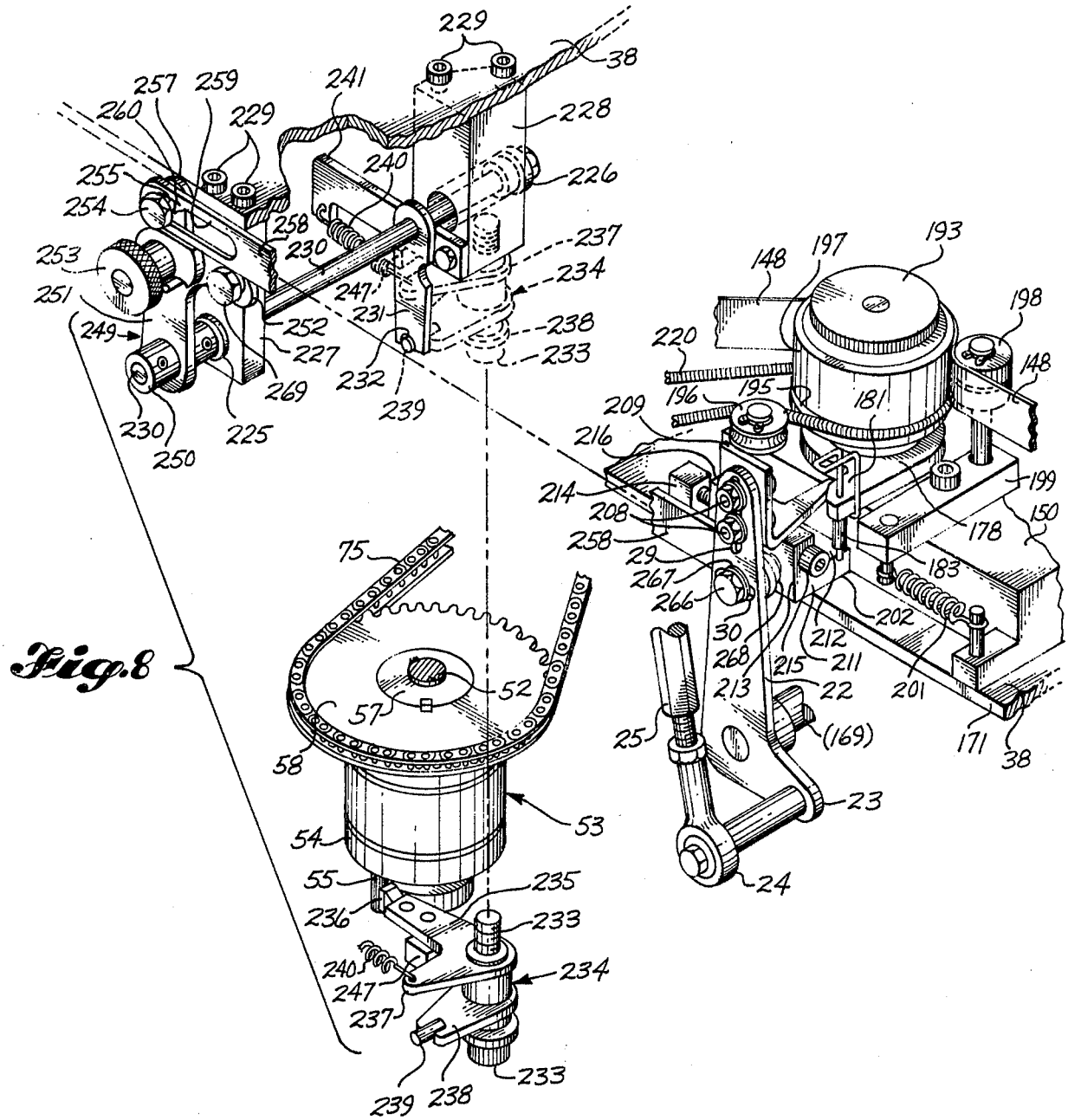
FIG. 8 is a diagrammatic enlarged exploded perspective view of the imprinter power clutch and ink ribbon feed mechanisms at rest during an interval between successive imprinter cycles.
Figure 13:
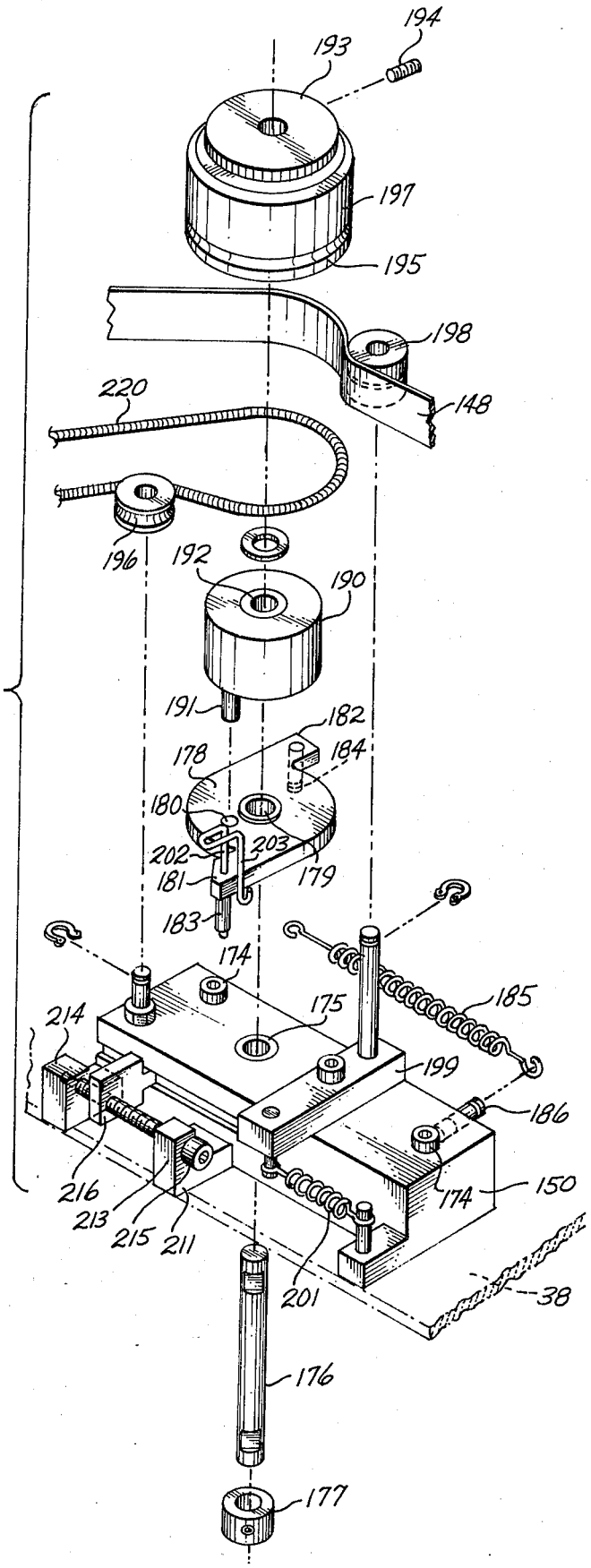
FIG. 13 is an exploded perspective detail view of the cold printing ribbon feed roller and intermittent clutch operating rocker lever means.

Referring to FIG. 8, which shows the machine parts during a pause between successive bag closing cycles, it is noted that two bolts 208 extend through lengthwise slot 29 in arm 22 fixed on shaft 169 of bag closing machine 28, to adjustably fix to said arm a sheet metal stamping 209 from which a tape feed actuator blade 210 extends towards and terminates in front of and is forced against tangential ear 181 on actuator lever 178 so as to hold the latter lever rotated counterclockwise to give a maximum extension to the spring 185 which connects to the other ear 182 of said lever (see FIG. 5).

In approximately the transverse middle plane of the machine in which the aforesaid contact between blade 210 and lever ear 181 takes place, a boss 211 extends outwardly from and leftwardly along block 150 parallel with deck edge 171. A horizontal channel 212 is formed downward in boss 211 deep enough to freely receive the tubular stop 183. Spring wire latch 202, however, is aligned with the space just downwardly in front of boss 211 and when manually depressed during an interval between bag closing cycles, will lock lever 178 in the position in which it is shown in FIG. 5, the purpose of this being pointed out in the description of the operation. However, the latch 202 is generally withdrawn upwardly into the tubular stop 183 so as not to obstruct the normal function of the foil feeding lever 178.

The outer wall of channel 212 is milled away to form a pair of short concentrically apertured posts 213 and 214 in which is mounted a screw 215 for adjustably controlling the space in channel 212 between a limit stop 216 and tubular stop 183. Thus, by setting screw 215, the length of foil ribbon 148 advanced through the imprinter 35 following each cycle may be controlled.

Aluminum base block 151 is screwed to the opposite side edge of middle deck plate 38 from base block 149 and is bored vertically to receive a foil spool shaft 217 carrying a used foil ribbon winding spool 218 having on its bottom a pulley 219 which is horizontally aligned with and connected to idle pulley 196 and annular feed roller pulley groove 195 by an easily slipping endless coiled spring 220. As shown in FIG. 5, the used end portion of ribbon 148, after leaving feed roller 193, extends to and is wound onto spool 218 in an anti-clockwise direction.

Referring now to FIGS. 2, 3, 4, 7, 8, 11, 12 and 13, the mechanism for coordinately cycling the bag closing and closure imprinting systems of the invention are seen to be as follows:

Journalled in bearings 225 and 226 provided in hangers 227 and 228 secured by screws 229 to and extending downward from middle deck 38 is a horizontal transversely disposed clutch actuating shaft 230 having welded thereto an arm 231 having an open mouth 232 at its end. Rotatably mounted on a post 233 screwed into a vertical tapped hole in the bottom of hanger 228 is a clutch actuating lever unit 234 integrally including a clutch stop mounting arm 235, carrying a hardened clutch stop 236, a co-planar spring connecting arm 237 and a downwardly spaced radial pin arm 238, the pin 239 in which interfits at right angles with mouth 232 of arm 231.

The hanger 228 is juxtaposed relative to clutch 53 so as to normally place stop 236 in opposition to anticlockwise rotation of the clutch by engaging the control dog 55 of the clutch. Stop 236 is biased into such a position of opposition to dog 55 by a coil spring 240 connected at one end to spring connecting arm 237 and at the other end to an actuating lever stop 241 which is fixed by screws 242 to the hanger 228.

The stop 241 has a lug 247 which extends downward into the path of spring connecting arm 237 so as to limit clockwise rotation of arm 235 in response to spring 240, to the position in which it is shown in FIG. 8.

Fixed by set screws 248 on the extending end of shaft 230 is an actuator drive lever unit 249 including a hub 250, an upstanding lever arm 251 and a rightward extension 252 from said arm. A spring retarded clutch bypass knob 253 is pivotally mounted on the front face of lever arm 251 on the level of extension 252. Mounted on the upper end of lever arm 251 is a clutch actuator catch 254 in the nature of a broad headed screw which screws into a tapped hole in arm 251 leaving a round portion of the stem 255 of said screw bare between lever arm 251 and the head 256 of said screw. A lock nut 257 is applied to the inwardly extending end of stem 255 to fix the setting of catch 254 on arm 251 to allow enough space between said arm and the flat head 256 of said catch for a flat slotted latch actuator 258 to be trapped therebetween and ride freely on the catch stem 255 incidental to its actuating clutch 53.

The left end portion of actuator 258 has a horizontal slot 259 in the upper edge of which a downwardly extending tooth 260 is formed for a purpose to be explained later. The stem 255 penetrates slot 259 and the flat head 256 traps the actuator 258 in horizontal sliding relation with clutch actuator catch 254. The right end of actuator 258 has a round hole in which pivotally journals a hex-headed internally threaded bearing 265 in which a screw 266 is threadedly received after extending through a washer 267, the crossways slot 30 in arm 22 and a washer 268.

A hex-headed cam 269 from which is formed an eccentric bolt 270 is secured to extension 252 of arm 251 by extending said bolt through an aperture in said extension and applying a lock nut 271 to said bolt. By adjustably rotating cam 269 and setting it by tightening nut 271 the timing of the functioning of latch actuator 258 may be accomplished as will be explained in describing the operation of the invention.

OPERATION

The bag closing system 20 embraced in the present invention (and for a description of one embodiment of which reference has been made to U.S. Pat. No. 3,163,972) is designed to accomplish the consecutive delivery of springy stiff plastic bag closures connected serially in strip form to a work station where the slack open end portion of a bag which concurrently arrives at said work station, is gathered automatically into an interior aperture of an endmost closure of the strip whereupon said closure is separated from the next closure in the strip and is carried with said bag from the machine. Immediately following this, the closure strip is shifted automatically to advance said next closure to said work station in time to receive and capture the neck of the next loaded bag arriving at said station.

The closure strip 118 is manufactured and shipped in coils about 18 inches OD, for receiving which, reels 272 and 273 are supported overhead on arm 274 of the machine, the first of which reels holds a coil 275 of just closure strip 118 and the other of which holds a coil 276 of closure strip 118 to each closure in which has been glued a cardboard label 277. The bag closing machine 28 is readily adapted to optionally operate with either of these styles of closure strip and the reels 272 and 273 are swingable in making this election to place one or the other of these reels in radial alignment with the closure strip feed guide 114 of the machine. This done, the particular style of closure strip 118 elected is manually fed downwardly through said guide and the imprinter 35 to place the endmost closure 280 at the closure applying work station between the two tangential pairs of bag neck gathering wheels of the bag closing machine 28.

The imprinter 35 is also supplied with a fresh roll 156 of printing foil ribbon 148 by inserting the roll in spool 153 and threading the ribbon 148 leading from said spool, as shown in FIG. 5, around guide rollers 157, 158, 169, 170, 198 and ribbon feed roller 193 from which the end of ribbon 148 is wrapped around ribbon rewind spool 218. This spool is only lightly driven frictionally through endless coiled spring 220 to merely rewind thereupon the amount of ribbon 148 positively fed between the feed roller 193 and the idle pressure roller 198. This foil ribbon feed in the imprinter 35 is effected by the oscillation of the arm 22 caused by rocking of shaft 169 of bag closing machine 28 during successive bag closure applying cycles of said machine. During each such cycle, the arm 22 swings from its position shown in FIG. 3 to its position shown in FIG. 4 and then returns to its starting position. During the initial half of this cycle, the foil ribbon acutating blade 210 moves away from actuator lever ear 181 which, biased clockwise by coil spring 185, follows blade 210 remaining in contact with it until tubular stop 183 on ear 181 comes in contact with adjustable limit stop 216 whereupon the clockwise rotation of lever 178 is halted with arm 22 continuing leftward to complete its first half cycle. Then, while returning to its starting position, blade 210 resumes contact with tubular stop 183 and imparts an adjustable degree of counterclockwise rotation to actuator lever 178 which in turn is transmitted through pin 191, collar 190, clutch 192, shaft 176 and set screw 194 to foil ribbon feed drive roller 193. The foil ribbon 148 is thus advanced by this distance throughout the imprinter 35 from spool 153 to spool 218.

It is thus seen that by changing the position of adjustable limit stop 216 by rotating screw 215, the precise distance which foil ribbon 148 is advanced through imprinter 35 during each cycle of its operation may be effectively controlled.

Figure 3:
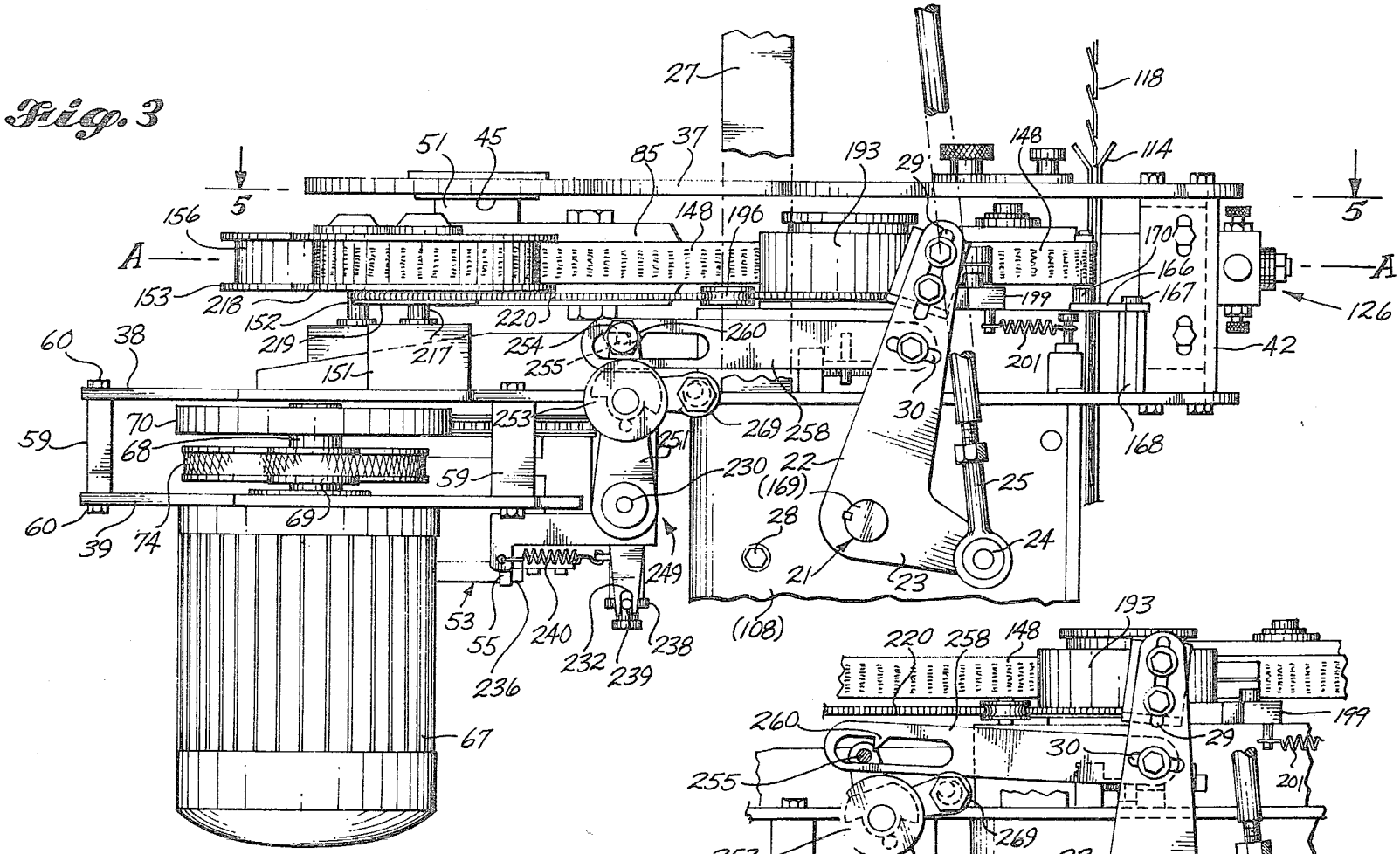
FIG. 3 is a fragmentary side elevational view taken from the opposite side of the machine as FIG. 2 with the machine parts likewise at rest.

It is also to be noted that the advancing of the foil ribbon 148 takes place during the concluding portion of the bag closing cycle after the printing cycle has completed its impression and retracted the type faces from contact with the foil ribbon 148, whereby the latter is free to respond to feed roller 193. This is accomplished in the following manner:

The tooth 260 in slot 259 in the latch actuator 258 rides idly over and drops down behind stem 255 of catch 254 (as shown in FIGS. 3 and 8) at the conclusion of each cycle of imprinter 35. The first thing to happen when a cycle of bag closing machine 28 starts, therefore is for the tooth 260 to swing the arm 251 counterclockwise which movement is transmitted through shaft 230 and arm 231 to clutch actuating unit 234 triggering clutch 53 and instantly starting a single revolution of cam 81 and a printing cycle so that the first half thereof is completed and the strip closure and foil ribbon 148 are released and are free for being fed during the final portions of the respective bag closing machine and imprinter cycles.

Figure 4:
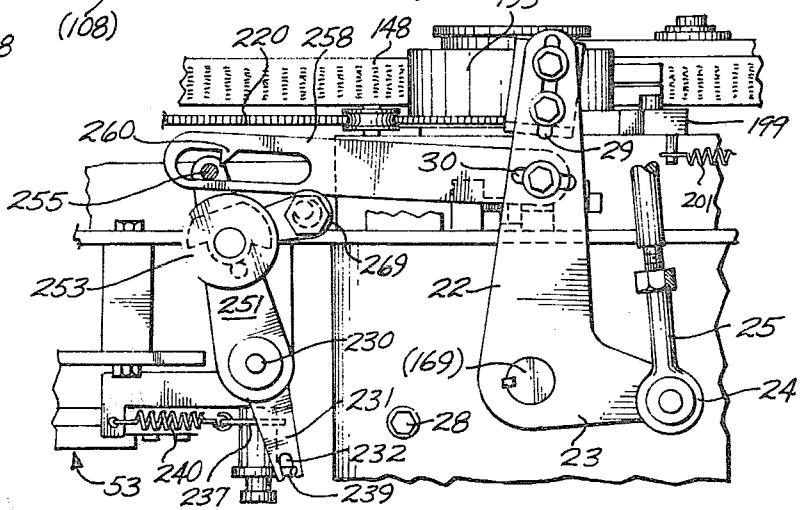
FIG. 4 is a fragmentary view similar to FIG. 3 with the parts shown in the middle of an imprinting cycle.

As shown in FIG. 4, the rotation of shaft 230 by hook 260 engaging stem 255 of catch 254 causes hex-headed eccentrically mounted cam 269 to engage the lower edge of latch actuator 258 and kick the tooth 260 upwardly above catch 255 thereby instantly releasing clutch stop 236 (FIG. 8) and allowing it to be spring biased back into a position to intercept clutch dog 55 and halt the current imprinter cycle precisely at the moment at which deep cam detent 82 receives therein the spring biased cam follower roller 83 (FIG. 5).

The principal advantage of this extreme adjustability is being always certain that notwithstanding a large variation in the rate at which the bag closing machine 28 operates, there will always be one printing cycle (and only one) for each bag closing cycle and the printing cycle for that bag closing cycle will always be properly coordinated therewith no matter how rapidly the bag closing cycles follow each other. With bag closing machine 28 having a maximum current capacity of closing 120 bags per minute the attainment of the degree of coordination thus required is a very considerable advance in the art.

The facility with which the operator may turn the imprinter 35 off and on again without stopping the motor 67 and while the bag closing system is still functioning at full speed is another great advantage when the customer desires to dispense with the printing on the closures used in packaging a certain portion of his product and then, forthwith, resume printing closures used on the rest of his product. This is accomplished by just turning knob 253 counterclockwise a quarter turn, whereupon it supports the member 258 so that tooth 260 entirely misses engagement with stem 255 of the clutch actuator catch 254. Thus, so long as knob 253 remains so positioned, the imprinter will not cycle.

The cycling of the foil ribbon feed system 147 is separately controlled by spring latch 202. To save ribbon during a pause in cycling the imprinter, said latch is positioned, as previously described, to prevent clockwise movement of the ribbon feed lever which also prevents any returning counterclockwise movement of said lever which alone acts to feed ribbon 148 through the imprinter.

Figure 14:
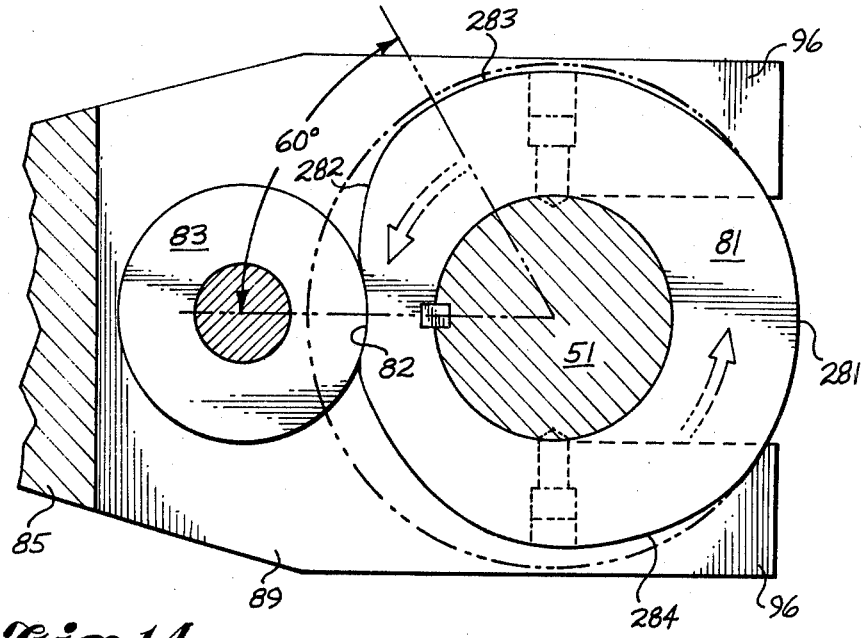
FIG. 14 is an enlarged diagrammatic plan view of the imprinter drive cam and follower roller of the invention.
Figure 15:
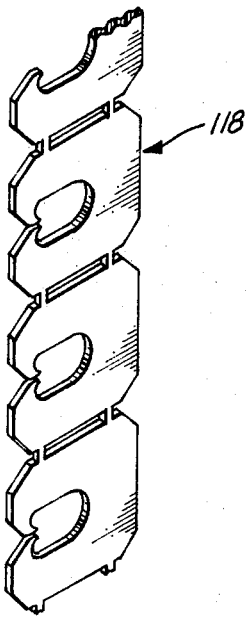
FIG. 15 is a perspective view of a closure strip of the Kwik Lok type which the invention is optionally adapted to use in closing bags.
Figure 16:
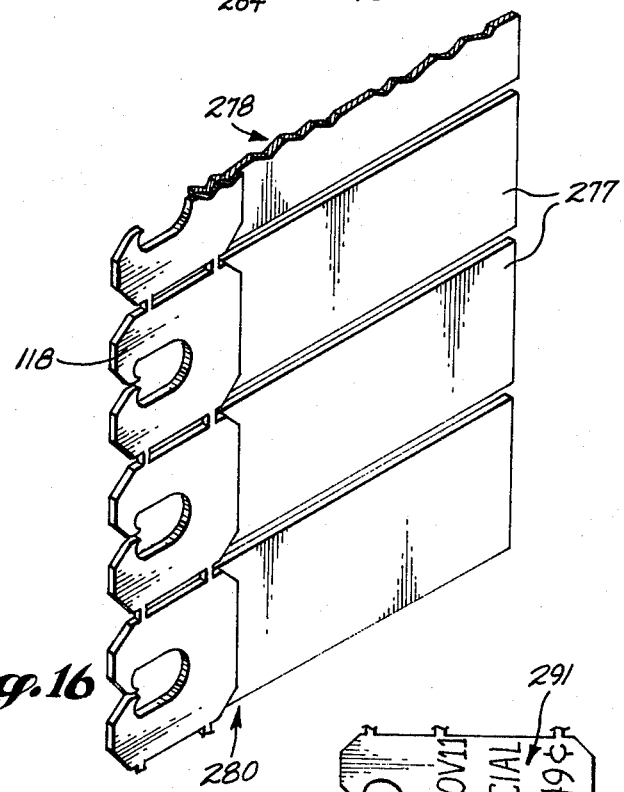
FIG. 16 is a perspective view of a closure strip with individual labels glued to the respective closures in the strip and with which the invention is also adapted to optionally function.

The present invention is not only effective in coordinately co-cycling the bag closing and power dry-cold foil printing operations and optionally cutting out the imprinter while the bag closing machine continues to run, but it provides for effecting the contact of the type faces of metal with the foil ribbon at a relatively slow speed and with magnified power produced by a relatively light weight low powered electric motor 67. FIG. 14 illustrates the part played by the cam 81 and follower roller 83 in this economically meaningful power printing system.

To recapitulate, the cam 81 is normally stationary, keyed to shaft 51 which is integral with clutch shaft 52, the lower end of which has fixed thereon the lower half 54 of clutch 53, and the upper half 56 of which clutch turns continuously with the sprocket 58 fixed thereon. The motor 67 rotates constantly at 1700 RPM and drives sprocket 58 at 238 RPM (or at 4 RPS) which produces one complete cycle in one-quarter second. Each imprinter cycle starts and stops with the clutch control dog 55 held against rotation by the hardened clutch stop 236 (FIG. 8). Withdrawal of the latter starts a printing cycle and a quick return thereof behind said dog terminates the cycle forthwith upon the dog engaging the stop one quarter of a second later. Due to the low amount of inertia residing in the cam shaft and cam there is only a very slight lowering of the speed of the motor 67, sustained as it is by flywheel 70, incident to triggering clutch 53 to start a printing cycle.

It is to be noted that detent 82 at the beginning and end of each printing cycle is facing leftward aligned with the pivot pin 98 and the follower roller 83 is powerfully spring biased into and occupies said detent. The zenith or high point 281 of cam 81 is 180° from the center of detent 82. As the cam rotates counterclockwise at the start of a cycle, roller 83 is lifted from detent 82 onto an initial phase cam shoulder 282 which shifts the type holding block 88 in to close proximity (about 1/64 inch) with the foil ribbon 148 overlying the closure or label which is pausing in backed up relation with the anvil 119, before initiating actual content between the type faces 95 and said foil ribbon 148. At 60° from dead center, a secondary phase cam shoulder 283 starts under roller 83 which shoulder is 120° long thus terminating at the cam zenith 281 and uniformly gradually propelling roller 83 while opposite said shoulder, a total distance of 1/64 of an inch. This motion is of course transmitted relatively slowly and firmly to the type faces 95 to produce a superior printed type image on the closure 280 (or label 277) pausing at the moment within the printing area defined by the anvil 119.

Devoting the 120° of cam shoulder 283 to the function of gradually moving the type faces 95 only the final 1/64 inch of the 1/4 inch positive movement of said type faces during the printing cycle not only improves the quality of the printing image produced but minimizes the torque required to rotate cam 81 through that 120° so that the motor 67 (of only 1/16 horse power) will tolerate the additional restraint imposed by springs 97 on the rotation of cam 81 through that 120°. Any retardation suffered incidental to such restraint is however compensated for by the "downhill" path followed by roller 83 during the second half of the printing cycle as it rolls down the final 180° declining shoulder 284 of cam 81, which delivers the roller 83 with an affirmative snap into the detent 82 coincidentally with the clutch control dog 55 being halted by the clutch stop 236 (FIG. 8).

Figure 6:
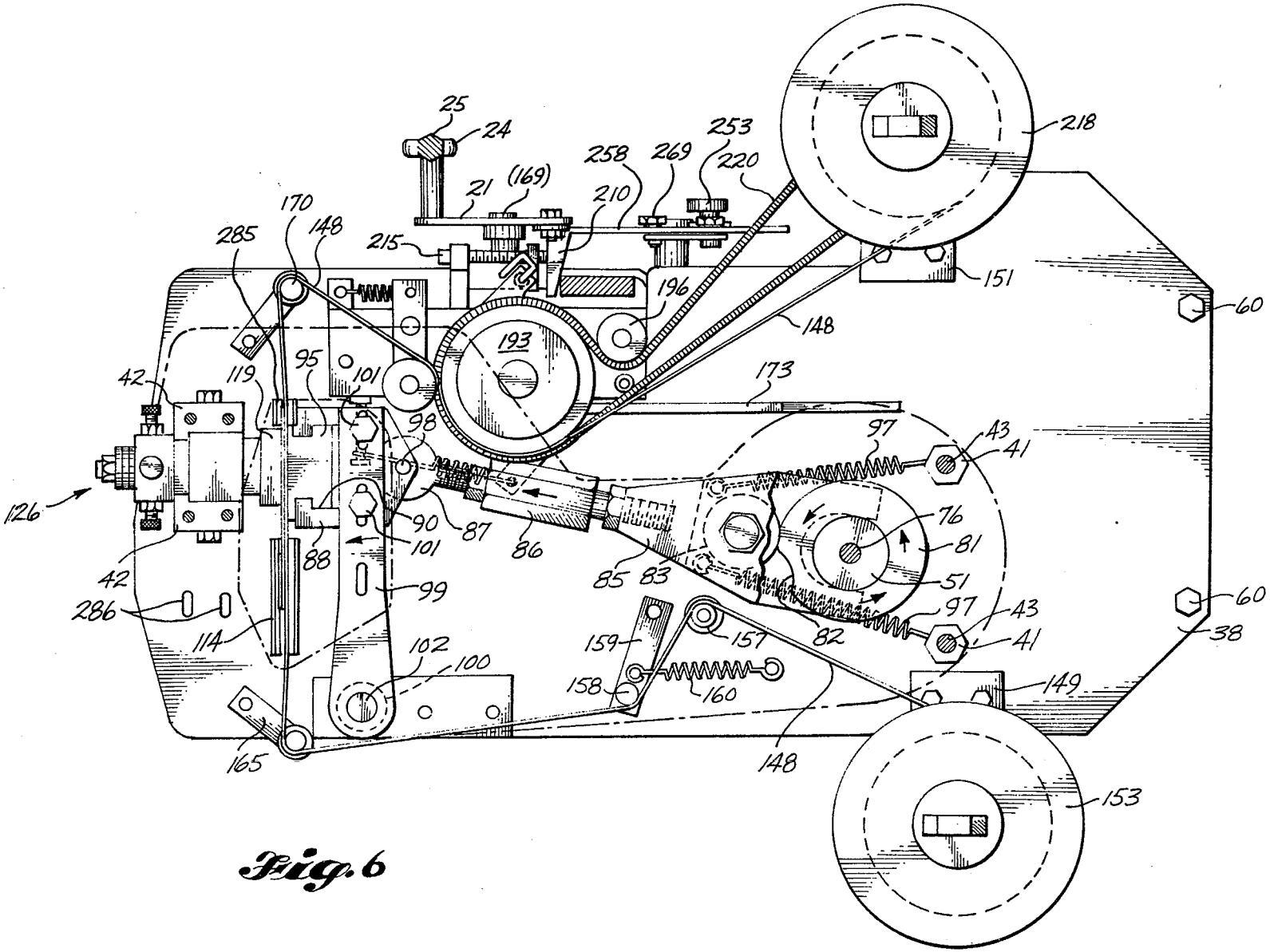
FIG. 6 is a view similar to FIG. 5 with the parts shown as positioned at a certain point of time during a cycle of the machine. The printing cam is about to complete its single revolution during which the imprinter has made its type impression on the closure overlying the printing anvil, the ink ribbon being at rest during that short interval, and the cam follower roller is about to drop into the cam detent just in advance of the roller which will retract the type faces clear of the work at the moment the ink ribbon feed roller starts to turn to feed the ribbon.

It is to be noted (FIGS. 5, 6 and 7) that the invention is adapted to optionally employ either a plain closure strip 118 without labels, or such a closure strip having labels 277 glued respectively to the individual closures thereof. The imprinter 35 is also optionally operable to apply printed images, when running closure label strip 278 through the machine, either to each closure in the strip or to each label thereof. Mounted on plate 37 in hole 115 is a guide 114 for closure strip 118 and a guide 285 for labels 277 affixed to the closure-label strip 278. FIGS. 5 and 6 show the imprinter adjusted for printing on said labels. These adjustments comprise:

1. Fixing type mounting block 88 on bifurcated arm 99 just inside the tip end of said arm by a proper choice of the slots 279 provided in arm 99.

2. Fixing anvil anchor posts 42 in selected pairs of slots 286 in decks 37 and 38 for receiving bolts 43 and 44 to align anvil 119 with type faces 95 and in supporting relation with each label 277 pausing in the printing area defined by said anvil.

3. Coordinately vertically adjusting anvil 119, type mounting block 88 and cam 81 so these are aligned for smooth operation in a horizontal plane bisecting said printing area.

4. Selecting and installing a clutch stop 236 of the proper length to halt each cyclic revolution of clutch 53 with cam detent 82 aligned with and occupied by cam follower roller 83.

When imprinter 35 is adjusted for printing on labels a stop 236 is required which is 3/16 inch longer than when the imprinter is adjusted to print on the closures of closure-label strip 278, or the closures of closure strip 118.

To prepare imprinter 35 for electing the latter option, the anvil anchor posts 42 must be shifted to the right as shown diagrammatically in FIG. 7, the type mounting block 88 must be shifted inwardly to a position near the hub 100 of bifurcated arm 99 and a clutch stop 236 installed which is 3/16 inch shorter than the stop used when printing on labels 277.

Figure 17:
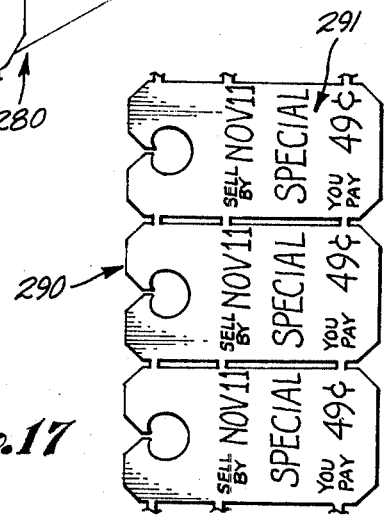
FIG. 17 is a view of a closure strip of a modified style adapted for use in the invention and illustrating a typical example of data imprinted on a closure by the invention.

A modified style of closure strip 290 is shown in FIG. 17 which the invention is readily adaptable for handling. This view also illustrates typical specimens 291 of printing applicable by the imprinter 35 to any of the various styles of closure strips and closure-label strips utilized by the bag closing system 20 of the invention in closing bags.

I claim:

1. A cold, dry co-cycling bag closure imprinting and bag closing machine adapted to be mounted alongside a conveyor delivering partially loaded slack necked polyethylene bags in a uniformly arranged serial order along a given path leading to and through a work station, said machine comprising:

a cyclically clutch powered means for intermittently advancing flat springy sheet plastic bag closures, each closure having a bag neck trapping aperture, along a different path leading to said work station to successively position such a closure with respect to each loaded bag as said bag is delivered to said work station, to present a slack neck portion of said bag to said bag neck trapping aperture in said closure;

means for gathering into the trapping aperture of the closure the slack bag neck presented thereto;

means for releasing said closure to allow it to depart with said bag from said machine;

an independently cyclically clutch powered cam actuated imprinter for cold-dry printing data on each of said closures during a pause in its travel along said closure path of advance; and trigger means responsive to said cyclic closure advancing means to activate and time the cyclic action of said imprinter.

2. A machine as recited in claim 1 wherein said machine includes a hollow tower structure and wherein said imprinter has a flat frame including rigidly vertically spaced upper and lower horizontal steel plate decks, said imprinter frame being mounted on top of and rigidly connected to said tower structure, said imprinter also including:

an anvil means rigidly supported between and on said decks near one end of said imprinter frame, said anvil means providing a vertical pressure face closely backing up said closure advancing path within a closure imprinting area of said path;

concentric main vertical bearings mounted respectively upon said decks on an axis distantly spaced from said pressure face;

a cam shaft journalling in said bearings;

a cam fixed on said shaft between said deck plates;

a metal type mounting block providing type faces;

guiding means on said imprinter frame for guiding said mounting block along a printing path accurately effecting a printing impression from said type faces on a bag closure pausing at said printing area;

means following said cam and connected to said printer block for cyclically producing such impressions on said closures;

an independently continuously energized drive motor for said imprinter; and a cyclic single revolution clutch mounted on said cam shaft and connected to said motor to produce cyclic single revolutions of said shaft when said clutch is triggered by said cyclic closure advancing means.

3. A machine as recited in claim 2 wherein said imprinter motor output drive shaft has directly connected thereto a fly wheel means for storing up torque energy therein during pauses between power cycles; and belt drive means interposed between said output drive shaft and said cyclic imprinter cam shaft drive clutch, to lower the output energy drag on the motor during printing cycles.

4. A machine as recited in claim 2 wherein means is mounted within and upon said imprinter frame for providing:

an unwinding supply roll of dry-cold printing ribbon;

means for guiding said ribbon along a path extending between said type faces and said closures in said printing area;

a rewinding roll for receiving and disposing of used printing ribbon;

means actuated by said cyclic closure feed means, while said closures are in motion, for effecting the unwinding of printing ribbon from the supply roll, the advancing of the ribbon through said guide means along said ribbon path and the winding of said ribbon upon said rewinding roll; and means for effecting manual adjustment of the precise distance the ribbon is machine advanced during each pause between successive printing cycles.

5. A machine as recited in claim 4 wherein said ribbon feed regulating means comprises a positive ribbon feed roller located between the printing area and the rewinding roll;

means for guiding said ribbon partially around said feed roller on its way to said rewinding roll, said means comprising a spring biased idle roll holding the ribbon against said ribbon feed roller;

means operable through an elastic drive belt to slippingly drive said rewind roll from said ribbon feed roller; and means cyclically driven by said cyclic closure feed means to positively partially rotate said ribbon feed roller to advance the ribbon a selected distance toward and wind the same on said rewind roll with each closure printing cycle.

6. A machine as recited in claim 5 wherein optical means is provided for manually cutting out the ribbon feed means while still continuing otherwise to operate the machine including the cyclic printing of the type faces on the closures, without benefit of ink, as in embossing.

7. A machine as recited in claim 5 wherein optional means is provided for manually cutting out the imprinter cyclic clutch trigger actuator thus suspending the printing function of the machine while continuing to perform the bag closing function thereof.

8. A machine as recited in claim 2 wherein manually adjustable cam screw means is provided to determine precisely the timing of the triggering of the imprinter single revolution cyclic clutch by the cyclic closure feed clutch whereby the proper coordination will be maintained between the two cyclic mechanisms.

9. A machine as recited in claim 2 wherein said anvil means comprises a pair of spaced posts fitting between and ajustably rigidly secured to said deck plates by screw means extending through said plates;

a cross block fitting between and vertically adjustably secured to said posts by screw means extending through said posts, there being a central bore in said cross block on a horizontal axis;

an internally disposed rectangular anvil head having an axial stem loosely extending outwardly through said bore; and means for tightening said stem optionally in said bore to adjustably set the anvil head dead on or with a desired deviational angle from said bore axis.

10. A machine as recited in claim 9 wherein said anvil stem oscillates neatly within the inner end of said block bore and loosely fits the balance of said bore; and wherein said stem is threaded and provided at its outer end with a metal washer and a nut and with two pairs of matching spheroid washers compressed respectively by the anvil head and the metal washer against said block; and wherein a hub extends forwardly co-axially from said block providing plural tapped radial holes; and independent lock nut set screws in said holes for setting said stem with any desired angular adjustment allowed by said bore.

11. A machine as recited in claim 10 wherein a radially exposed bearing face is formed on said stem for engagement by each of said set screws to give said anvil head a plumb position regardless of its axial deviation.

12. A machine as recited in claim 11 wherein vertical adjusting set screws are provided in said deck plates vertically axially bearing on said cross block to aid in vertically adjusting said block to a given level, after the screws securing said posts to said block are relaxed, and then setting said block at said adjusted level by retightening said post screws.

13. A machine as recited in claim 10 wherein said central bored block and said block mounting posts are vertically rabetted to interlock at their contiguous side edges, with their rear faces and their front faces respectively flush and with said adjusting hub extending axially forwardly from said front block face.

14. A machine as recited in claim 2 wherein said metal type mounting block guiding means comprises a vertical pivot post fixed on one of said deck plates and having arm means pivotally mounted thereon and vertically adjustable, said block being fixed on said arm means; and wherein said cam following means pivotally connects on a vertical axis with said type mounting block and is spring biased into constant engagement with said cam.

15. A machine as recited in claim 14 wherein a vertically bored and tapped block is secured adjustably by screws to said one deck plate, and wherein said pivot post is threaded to screw into said block and has a lock nut to set said pivot post to pivotally support said arm means and said metal type mounting block at a selected level as the type faces on said block are swung toward and away from the work by the rotation of said cam.

16. A machine as recited in claim 15 wherein said cam follower means includes yoke blocks which embrace said cam and said cam shaft and are radially guided thereby; and means for vertically selectively setting said cam on said cam shaft to raise or lower the level at which said yoke blocks are thus guided.

17. A machine as recited in claim 16 wherein said cam follower means also includes a cam following roller;

a knuckle block having an apertured cleft in which said roller is pivotally pin mounted and on the rear faces of which block said guide yoke blocks are fixed;

a pair of spring posts behind said cam shaft spanning the space between said deck plates; and a pair of coil springs connecting opposite sides of said knuckle block to said spring posts and constantly biasing said cam follower roller against said cam.

18. A machine as recited in claim 17 wherein said pivotal connection between said cam follower means and said metal type mounting block is effected by providing a rearward extending apertured cleft in said block;

a tapped axial hole provided in said knuckle block; and a turnbuckle including a terminal threaded eye-bolt, the eye of which is pivotally pinned in said apertured type block cleft, the other end of said turnbuckle being connected rigidly with said cam roller mounting knuckle block by being screwed into said tapped axial hole.

19. A machine as recited in claim 2 wherein said cam following means includes a roller pivotally mounted thereon;

means for radially guiding said roller on said cam and said cam shaft; and means for constantly spring biasing said roller against the periphery of said cam.

20. A machine as recited in claim 19 wherein the perimeter of said cam presents to said follower roller, at the conclusion of a single revolution cycle, a detent adequate under said spring biasing to halt the turning of said cam with said roller depressed into said detent.

21. In a cold, dry co-cycling bag closure imprinting and bag closing machine, the combination of:

means for lineally guiding flat springy sheet plastic bag closures, each closure having a bag neck trapping aperture, said closures being separably joined edge to edge in strip form, to a work station;

means for successively engaging the slack necks of a series of partially loaded flexible plastic bags delivered to said station and gather the neck of a leading bag into the aperture of the endmost of said closures;

clutch powered means cyclically triggered by said leading bag to separate said endmost closure from said closure strip allowing it thus to depart from the machine with said leading bag and then advance said strip the length of the next closure to present such closure to said work station to receive the bag neck of the next bag of said series;

an independently cyclically clutch powered cam acutated imprinter for cold-dry printing data on each of said closures during a pause in the travel of said closure strip in said strip guiding means; and trigger means responsive to said cyclic closure advancing means to activate and time the cyclic action of said imprinter.

22. A machine as recited in claim 21 wherein a closure strip having labels glued to the respective closures thereof and extending laterally therefrom is acceptable for optional use in said machine; and means embodied in said imprinter for setting the same for optionally printing data on either the closures or the labels in said closure-label strip.

23. A machine as recited in claim 22 wherein said machine includes a hollow tower structure and wherein said imprinter has a flat frame including rigidly vertically spaced upper and lower horizontal steel plate decks, said imprinter frame being mounted on top of and being rigidly connected to said tower structure, said imprinter also including:

an anvil means rigidly but adjustably supported at its upper and lower ends on said decks to provide a vertical anvil face closely juxtaposed to said closure-label strip being advanced along said strip guide means, said anvil means being adjustably shiftable to either back up the closures or the labels of said closure-label strip for optionally electing whether to print on said closures or on said labels;

concentric main vertical bearings mounted respectively upon said decks on an axis relatively distant from said anvil face;

a cam shaft journalling in said bearings;

a cam fixed on said shaft between said bearings;

a metal type mounting block providing type faces;

guiding means on said imprinter frame for guiding said type mounting block along a printing path accurately effecting a printing impression from said type faces in a selected printing area, said type block guiding means being adjustable to elect a printing area positioned for printing said impressions either on the closures or on the labels of said closure-label strip;

cam follower roller means, following said cam and connected to said printer type block for accomplishing said impression;

an independently continuously energized drive motor means for said imprinter;

a cyclic single revolution clutch mounted on said cam shaft and connected to said motor means to produce cyclic single revolutions of said shaft when said clutch is triggered by said cyclic closure-label strip advancing means; and means operating in timed relation with said clutch to feed a cold-dry foil ribbon between said type faces and said closure label strip.

24. A machine as recited in claim 23 wherein said type mounting block guiding means comprises an arm pivotally mounted vertically on one of said deck plates, said block being adjustably mounted lengthwise on said arm to selectively position said block to make type impressions optionally on said closures or on said labels of said closure label strip, said type block having a vertical pivotal connection with said cam follower roller means.

25. A machine as recited in claim 24 wherein said cam follower roller means includes:

a roller;

a knuckle having a horizontal cleft in its back end in which said roller is rotatably mounted to bear on said cam;

a turnbuckle fixed at its rear end to said knuckle and having an eye pivotally mounted on said type block in a horizontal cleft formed rearwardly therein;

a pair of yokes fixed rearwardly on said knuckle above and below said roller to slideably guide said knuckle radially on said cam shaft and cam; and means spring biasing said roller constantly against said cam.

26. A machine as recited in claim 25 wherein a detent is provided in the face of said cam in which said roller lodges precisely at the conclusion of each cyclic revolution of said cam;

a steep shoulder being provided in the initial 60° of movement of said cam which juxtaposes the type faces close to but still not touching the work;

a very gradually sloping secondary shoulder being provided in the next 120° of said cam which effects the printing impression of said cycle;

a uniformly declining final shoulder is provided terminating at said detent which shoulder functions to discharge the elastic energy stored in said spring means during the first half of each cycle to accelerate said drive motor means during the final half of said cycle; and means for adjusting the means for triggering the engagement and accomplishing the opening of said clutch so that each cyclic revolution of said clutch will begin and terminate with said cam detent positioned to receive and be occupied by said cam follower roller, and thus to adapt the functioning of said clutch to the optional choice made as to whether to print data on the closures or on the labels of said closure-label strip.

27. An imprinter adapted to be readily incorporated as an accessory unit with a bag closing machine for printing data on a closure strip being fed intermittently into said machine in timed relation with the advancing of partially loaded flexible bags to said machine whereby an individual closure is applied to each of said bags and then separated by said machine from said strip, said imprinter comprising:

a flat plate frame means;

means for rigidly securing said frame means to said machine;

anvil means on said frame means backing up said closure strip in a given printing area during intermittent pauses in the feeding of said closure strip;

a cam shaft parallel with the operative face of said anvil means;

bearing means on said frame means in which said shaft journals;

a cam fixed on said shaft in a plane bisecting the operative face of said anvil means;

a type face carrying printing block;

means for guiding said block into and out of printing relation with said closure strip in said printing area;

cam follower means, spring-biased into constant engagement with said cam, said means being connected operatively with said printing block, the contour of said cam producing a single printing impression on said closure strip with each revolution of said cam;

a single revolution clutch mounted on said cam shaft;

a reduction-geared continuously running motor power means connected to said clutch;

means for feeding a dry-cold foil ribbon between said type and said closure strip in said printing area;

means for triggering said clutch to produce a printing impression during each pause in travel of said closure strip; and means for actuating said ribbon feed means to advance said ribbon during each intermittent movement of said closure strip.

28. An imprinter as recited in claim 27 wherein said anvil means and type block guiding means are mutually adjustable so as to laterally shift the locations of said anvil means supported printing impressions on said closure strip.

29. An imprinter as recited in claim 28 wherein said anvil means, said guide means and said cam are adjustable in a direction parallel with the closure strip supporting face of said anvil means to shift the printing impressions lengthwise of said closure strip.

30. An imprinter as recited in claim 27 wherein said type block guide means includes an arm pivotally mounted on said frame means on an axis parallel with said cam shaft and wherein said cam follower means is pivotally connected to said type block at one end and provided with a cam following roller at the other end plus a pair of guide yokes guiding said roller radially on said cam and said cam shaft.

31. An imprinter as recited in claim 30 wherein a detent is provided in the face of said cam in which said roller lodges precisely at the conclusion of each cyclic revolution of said cam;

a steep shoulder is provided in the initial 60° of movement of said cam which juxtaposes the type faces close to but still not pressed against the work;

a very gradually sloping secondary shoulder is provided in the next 120° of said cam which effects the printing impression of said cycle; and wherein a uniformly declining final shoulder is provided terminating at said detent which shoulder functions to discharge the elastic energy stored up in said spring biasing means during the first half of each cycle to accelerate said drive motor means during the final half of said cycle.

32. An imprinter adapted to be incorporated as an accessory of and be embodied with a bag closing machine, the latter receiving at a work station a series of partially loaded soft flexible plastic bags and guiding to said station a series of stiff springy sheet plastic closures united separably end-to-end in strip form, each closure having a bag neck capturing aperture recessed in a side edge thereof, said machine including means for gathering the slack neck of each of said bags in the aperture of an endmost closure of said strip and having means functioning in timed relation with said gathering means to separate said endmost closure from the strip and advance the strip to bring the next closure therein to said station, said closure separating and strip advancing means being actuated by the cyclic rocking of a shaft, first, in one direction to separate said endmost closure and then, in the opposite direction, to advance said strip the length of one closure, said imprinter comprising:

a frame having means for rigidly securing said frame to said machine;

anvil means fixed rigidly to said frame in a position to closely back up said closure strip in a selected printing area;

type carrying block means supported on said frame vis-a-vis said anvil means;

means on said frame for guiding a cold-dry foil ribbon through said printing area between said type and said closure strip;

a cam rotatably mounted on said frame on an axis in spaced parallel relation with said block means;

cam follower means connected to said block means and spring biased into constant pressure against said cam whereby a single revolution of said cam will produce a printing impression of said type on said closure strip;

a single revolution clutch co-axially connected to said cam;

geared down continuously running electric motor power means connecting to said clutch;

an arm adapted to be fixed on said bag closing machine shaft;

means connected to said arm and actuated thereby for triggering said clutch upon the first rocking of said shaft in a closure separating phase of operation of said bag closing machine; and means connected to said arm for advancing said printing foil ribbon through said imprinter responsive to the return rocking of said shaft during the closure strip advancing phase of operation of said bag closing machine.

33. An imprinter as recited in claim 32 wherein said last recited means is adjustable to vary the distance said ribbon is advanced during each cyclic rocking of said shaft.

34. An imprinter as recited in claim 32 wherein said next to the last recited means is adjustable to assure quick release of said means following its actuation to trigger said clutch, thus assuring disengagement of the clutch upon its completing a single revolution.

35. An imprinter as recited in claim 32 wherein said next to the last recited means is provided with a rotatable knob for rendering said means temporarily inoperative and thereby interrupt the performance of the imprinter while the bag closing machine still functions in closing bags.

36. An imprinter as recited in claim 32 wherein said last recited ribbon advancing means is provided with spring stop means for temporarily rendering said ribbon advancing means inoperative while said imprinter continues to function otherwise.

* * * * *